United States Patent [19]

Patriksson

[11] Patent Number: 4,861,170

[45] Date of Patent: Aug. 29, 1989

[54] PORTABLE CONTAINER

[75] Inventor: Stig Patriksson, Lilla Edet, Sweden

[73] Assignee: Patriksson Inventing AB, Alvangen, Sweden

[21] Appl. No.: 183,886

[22] Filed: Apr. 20, 1988

[30] Foreign Application Priority Data

Oct. 3, 1985 [SE] Sweden ..... 8504567
Jul. 14, 1986 [SE] Sweden ..... 8603106

[51] Int. Cl.[4] ..... B65D 33/12

[52] U.S. Cl. ..... 383/6; 383/20; 493/226

[58] Field of Search ..... 383/6, 20; 493/221, 493/226; 53/413; 206/617, 618

[56] References Cited

U.S. PATENT DOCUMENTS

| | | | |
|---|---|---|---|
| 1,093,695 | 4/1914 | Grizzard | 206/618 |
| 1,432,150 | 10/1922 | Bertin | 383/20 |
| 1,910,449 | 5/1933 | Rose | 383/20 |
| 2,293,952 | 8/1942 | Stroop | 206/617 |
| 2,406,018 | 8/1946 | Irmscher | 493/226 |
| 2,469,536 | 5/1949 | Winesett | 493/221 |
| 2,935,241 | 5/1960 | Brady | 383/907 |
| 3,373,925 | 3/1968 | Gatward | 383/20 |
| 3,486,421 | 12/1969 | Franson | 493/226 |

*Primary Examiner*—Stephen P. Garbe

[57] ABSTRACT

A portable container is provided consisting of an encasing member arranged so as to form a space in which objects can be carried and a handle member, consisting of at least one handle loop of string or similar material, which is attached to the encasing member. Attachment of the handle loop is accomplished in part by inserting at least one section of the string or similar material between two material layers of the encasing member, which are joined together by means of adhesive, whereby a channel is created between the layers of material through which said section of the handle member extends and in part by the nonuniformity in cross sectional shape over the length of said string or similar material when positioned in said channel in the completed package and by giving the channel such a form, that its shape and dimensions at least to a certain extent follow said nonuniformity in the string. The handle member is thereby secured to the encasing member even when the handle member is pulled in the longitudinal direction of the channel.

2 Claims, 6 Drawing Sheets

PORTABLE CONTAINER

This is a division of application Ser. No. 914,179, filed Oct. 1, 1986, now U.S. Pat. No. 4,759,743.

The present invention relates to a portable container consisting of an encasing member arranged so as to form a space in which objects can be carried and a handle member, consisting of at least one handle loop of string, which is attached to the encasing member.

The present invention also relates to a method of and apparatus for producing such container.

Portable containers for different purposes are previously known. The most common type of container can be said to be a carrier bag for temporary transportation of different types of goods. A carrier bag is equipped with handles and the construction of the handles as well as their attachment to the material of the carrier bag must meet exacting demands of strength and low production costs, whereby the latter demand is often particularly stringent. Even the construction of the carrier bag itself must meet specifications as to strength and preferably even stability.

The purpose of the present invention is to provide a portable container which fulfills strict requirements for strength and stability while still being inexpensive to produce.

Figure 1:
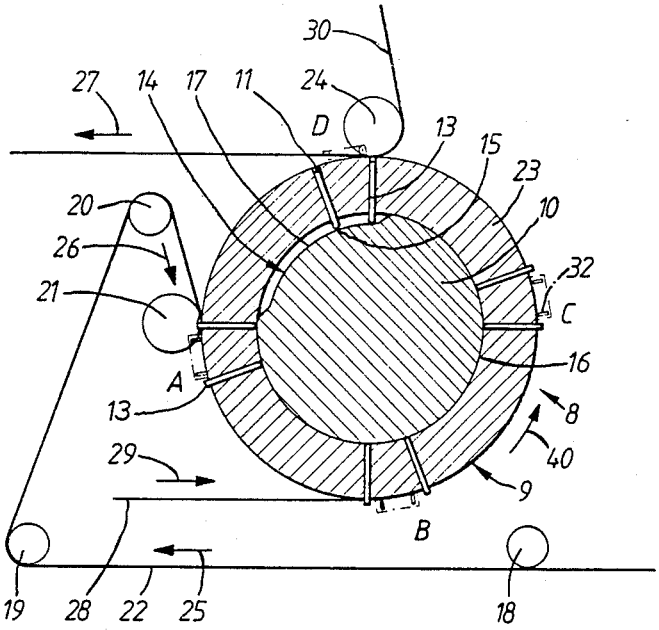
Figure 2:
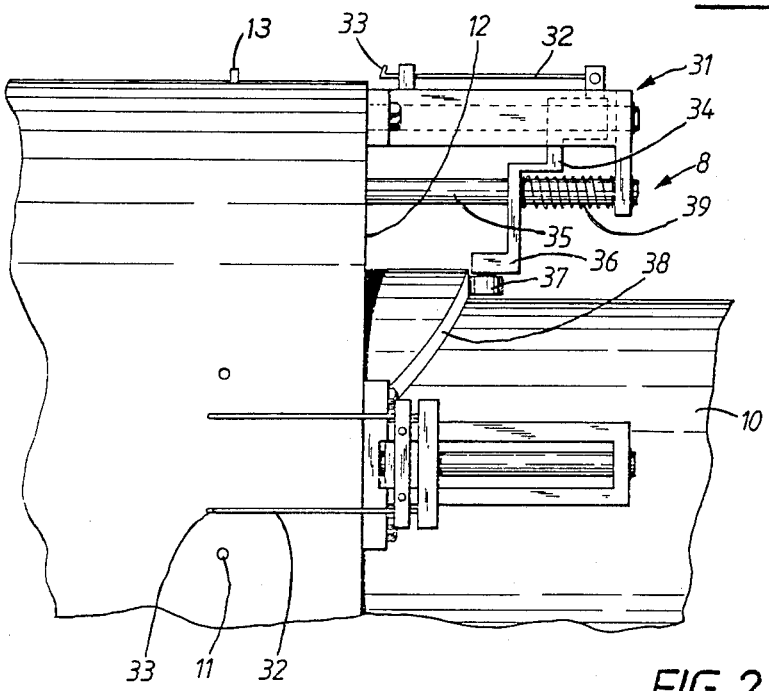
Figure 3:
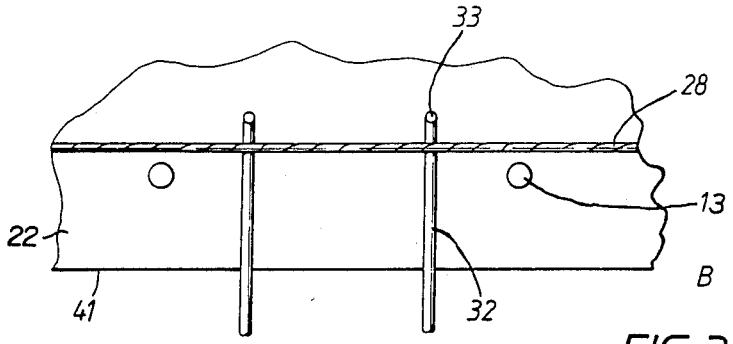
Figure 4:
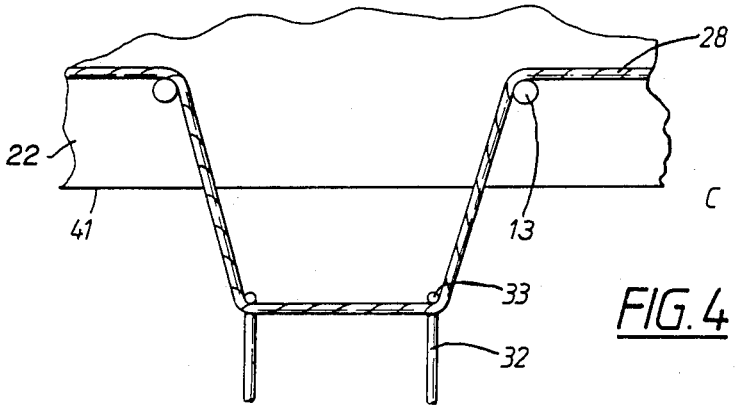
Figure 5:
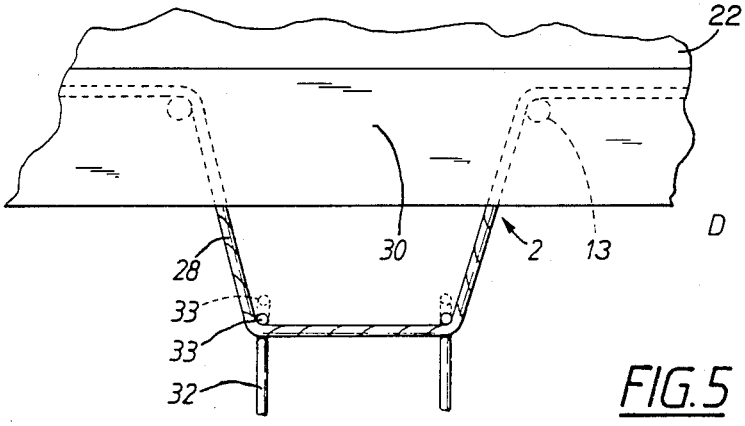
Figure 6:
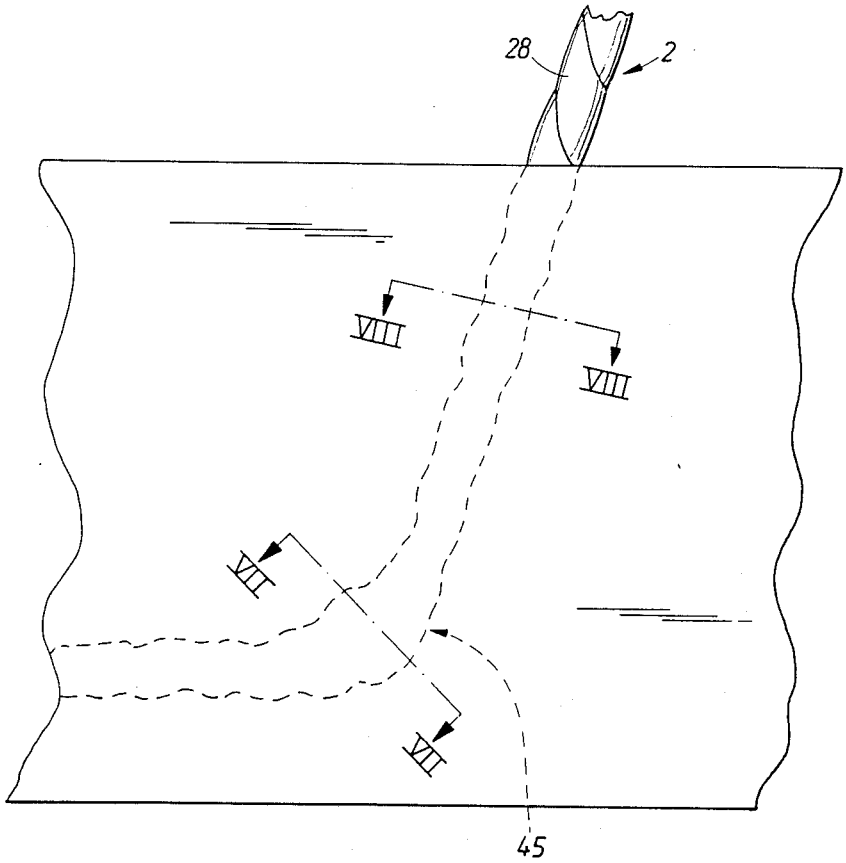
Figure 7:
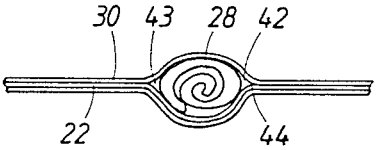
Figure 8:
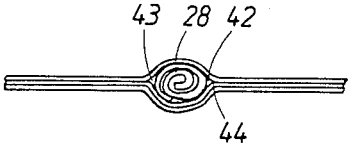
Figure 9:
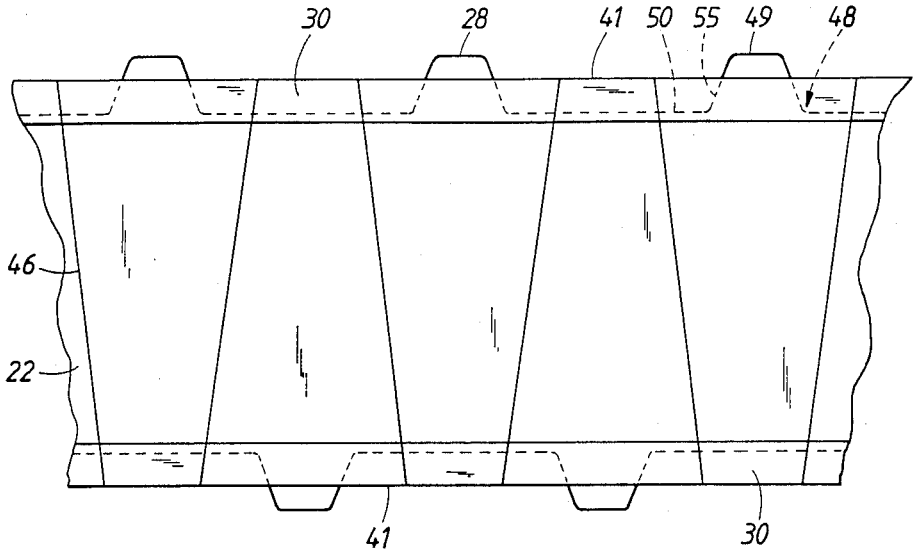
Figure 10:
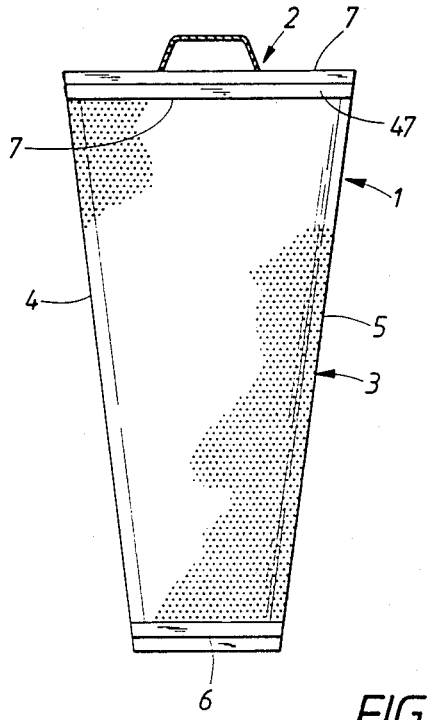
Figure 11:
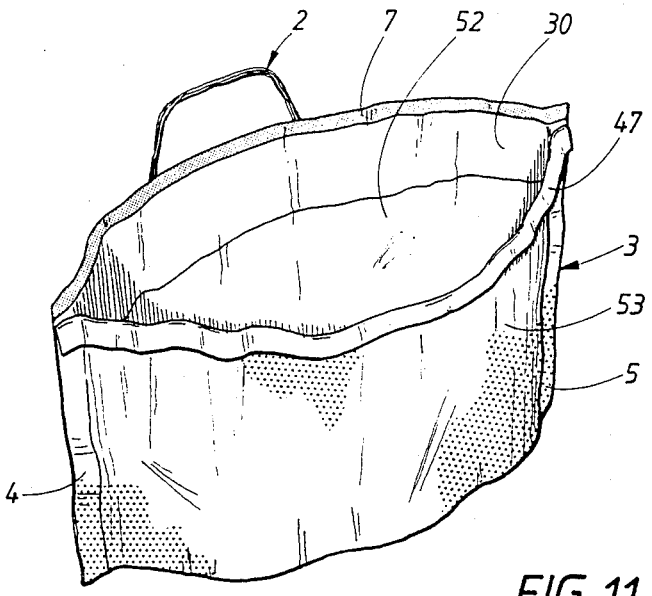
Figure 12:
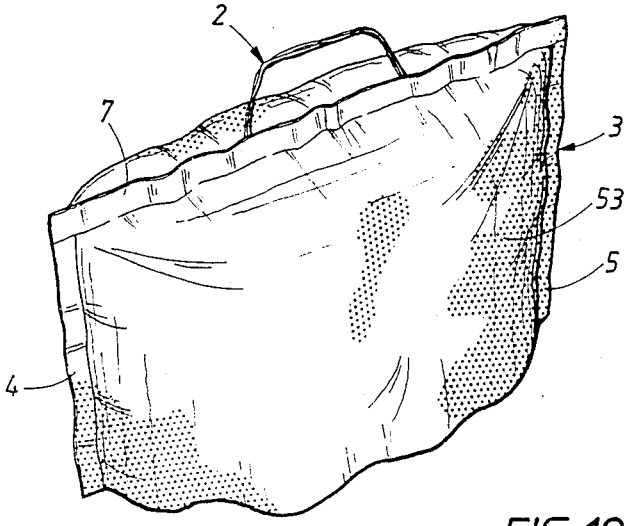
Figure 13:
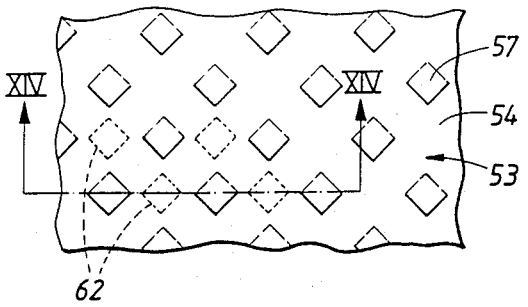
Figure 14:
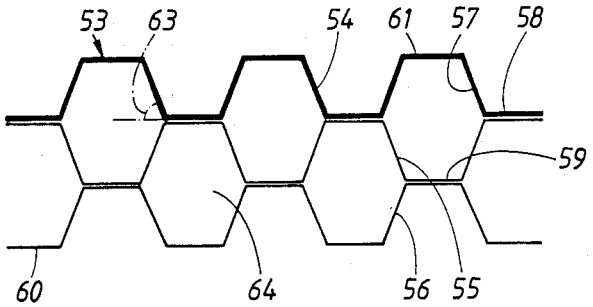

The invention will be described more precisely hereinbelow by means of an example, with reference to the accompanying drawings in which FIG. 1 shows schematically a cross section of a cylinder included in the device for making the container; FIG. 2 shows a partially broken view of said cylinder in larger scale; FIGS. 3, 4 and 5 show a section of said cylinder in even larger scale, showing the different stages of production of the container by the device; FIG. 6 shows a section of the portable container in even larger scale; FIGS. 7 and 8 show partially broken cross sections of a section of the container along the lines VII—VII and VIII—VIII; FIG. 9 illustrates a continuous material web of at least partially completed containers, while FIG. 10 shows a side view of the completed container. FIGS. 11 and 12 show a partially broken perspective view of an upper section of the container in its open and its closed configuration, respectively. FIG. 13 illustrates a broken view, in enlarged scale, of a portion of the container, while FIG. 14 shows schematically a cross sectional view in even greater scale taken along the line IX—IX in FIG. 13.

According to the invention, the production of the portable container is accomplished in a number of steps. In the present application only those steps will be described to which the present invention relates, namely, those dealing generally with the production of the container's 1 upper section, including the handle member 2. The completed container is illustrated in FIG. 10 and, by way of introduction, its principle construction will be described. The container consists mainly of said handle member 2 and an encasing member 3, which is intended to contain the object or objects, which are to be carried using the container. The encasing member 3 consists mainly of two oppositely positioned encasing walls which are joined along the side edge sections 4 and 5 of the container and the bottom edge section 6. The walls should preferably be made of a paper material which gives the container a certain stability while at the same time making the container shapeable so that a space is created between the two walls into which the object in question may be placed. In the simplest case it is conceivable that the handle member 2 consists of a single handle, fastened at the edge of the opening section 7 of one of the two walls. The container has an opening which is delimited by the opening edge section 7 of the two walls. For the case in which only a single handle is provided, the opening may be closed by applying to the edge of the opening section of each of the walls an adhesive substance, so that the edges of the opening sections of the respective walls, when pressed together, adhere to one another.

FIG. 1 illustrates schematically a device 8 for producing the handle member 2 of the container. In the given example, this device consists mainly of a cylinder 9. Said cylinder is mounted in bearings so as to be able to rotate about a stationary axle 10 and is driven by an unspecified motor. The cylinder 9 exhibits a plurality of cylindrical holes 11, such as drill holes, oriented generally in the radial direction of the cylinder. Said holes 11 are arranged in pairs and lie in a plane which is perpendicular to the longitudinal axis of the axle 10. This is best seen in FIG. 2, which shows a partially broken view in a larger scale. Pins 13 are provided, one in each of the drill holes 11, said pins being movable within the drill holes between an inner and outer radial position. A cam member 14 is provided, stationary with respect to the axle 10, the cam profile of which determines the position of the pins. In the example shown, the inner ends 15 of the pins lie against the cam profile, which is illustrated schematically as being the outer periphery of the axle 10. The cam profile exhibits an outer circular arc section 16 extending over roughly $\frac{3}{4}$ of the periphery of the axle and an inner circular arc section 17 extending over roughly $\frac{1}{4}$ of the periphery of the axle 10.

A first material web 22, preferably of paper, is lead via a plurality of rollers 18, 19, 20 and 21 from a supply roll (not shown) to the cylinder 9 whereupon it is brought into contact with the surface 23 of the cylinder by means of the roller 21, which exhibits a soft surface of, for example, foam rubber. The material web extends over approximately $\frac{3}{4}$ of the outer surface of the cylinder 9 and leaves the surface of the cylinder in a generally tangential direction after having passed a pressing roller 24, which also has a soft surface. The direction of feed of the material web is indicated by means of arrows 25, 26 and 27 in FIG. 1. Additionally, a string 28 or other narrow strip extends from yet another supply roll (not shown) towards the cylinder 9, running in the direction of the arrow 29 and extending around approximately $\frac{1}{2}$ of the periphery of the cylinder, a small distance away from the edge section 12 of the surface 23 of the cylinder, whereupon it finally leaves the cylinder together with the material web 22 in the direction of arrow 27. At the position where the material web 22 and the string 28 leave the surface of the cylinder a second material web, suitably in the form of a strip 30 and preferably of paper, is introduced, fed from yet another supply roll (not shown), and is pressed against the material web 22 by the soft roller 24 and is thereby redirected. At least one side of the strip is provided with an adhesive substance, for example, a dispersion glue, such as a water soluble polymer mixture.

As is best seen in FIG. 2, the device for producing the handle members has a plurality of traction devices 31, corresponding in number to the number of pairs of pins 13. Each traction device 31 exhibits a pair of traction hooks 32, which are arranged so as to extend in the axial direction of the cylinder close to the periphery of the cylinder. When extended, the traction hooks of each particular traction device will reach between the corresponding pair of pins 11. The traction devices 31 are movable between an axially retracted position wherein the traction hooks 32 lie outside of the edge section 12 of the cylinder and an axially extended position wherein the hook ends 33 of the traction hooks 32 reach slightly beyond the pins 11. Additionally, the traction devices 33 consist of a slide 34, which is movable along a double guide 35, consisting of two rod-shaped members. The slide is arranged so as to hold the traction hooks 32 so that they follow the movements of the slide. Moreover, the slide exhibits a sensing member 36 with a sensing roller 37, designed to follow a second cam member 38. The profile of the cam 38 is such that it controls the movement of the traction hooks 32 in the axial direction of the cylinder. The cam member 38 is attached to the axle 10 of the cylinder 9. The profile of the cam over the periphery of the axle is such as to move the traction hooks 32 between the abovementioned retracted and extended positions in accordance with the scheme which will be described in more detail below. The force required to drive the slide member 34 to its extended position is obtained in the example shown by means of a compression spring 39, arranged on the guide in such a way that the retracting motion to the retracted position is resisted by said spring.

Referring additionally to FIGS. 3, 4 and 5, the method of the present invention will now be described. For the sake of clarity, the positions about the periphery of the cylinder 9 of the traction devices 31 and the corresponding pins 11 are designated in FIG. 1 and also in FIGS. 3–5 by A, B, C and D. The material web 22, which consequently is to form one encasing wall or side of the container and, therefore, has a width equal to the height of the completed container, is fed in the direction of the arrows 25 and 26 and is applied to the surface 23 of the cylinder by the soft roller 21. The roller 21 is provided with a soft surface in order to absorb the deformation caused by the pins 11, which, because of the influence of the cam member 14, extend in the radial direction of the cylinder 9 so that their ends stick out slightly from the surface of said cylinder. At this point the traction device 31 is in its retracted position so that the traction hooks 32 do not obstruct the material web from lying against the cylinder surface. The cylinder 9 is caused to rotate continuously in the direction of the arrow 40, i.e., counter clock-wise. When the traction devices 31 move from position A to position B their respective traction hooks 32 are moved from the retracted position to the extended position in accordance with FIG. 3. Before entering at position B the string 28 essentially extends in the tangential direction of the surface 23 of the cylinder and beyond position B it lies on the periphery of the cylinder until it reaches position D. By means of members which are not shown, the string is controlled in such a way that it is introduced to the material web 22 at a predetermined distance from the web's edge section 41. As may be seen in FIG. 3 this distance is such that the string will be introduced between the hook ends 33 of the traction hooks 32 and the corresponding pair of pins 13. When the traction devices move from position B to approximately position C the traction hooks 31 are retracted to their retracted position. It should be pointed out that it is not necessary for the traction hooks to assume this position until immediately before they reach position D, i.e., before reaching the pressing roller 24. At this position, i.e., at or near position C, the hook ends 33 take hold of and pull the string 28 whereby the outwardly extending pair of pins 13 forms supports for the string so that an open, generally trapezoidal loop is formed. While this position, which is shown in FIG. 4, is maintained, the strip 30 is introduced and is pressed against the string at position D, as is shown in FIG. 5, whereby the string is squeezed between the wide material web 22 and the strip 30. Because of the applied adhesive and the action of the pressing roller 24, the band 30 adheres tightly to the material web on either side of the string. Immediately after position D the position of the traction device 31 is adjusted by means of the cam member 38 so that its traction hooks, which are in the retracted position, are slightly extended, as is indicated by the dotted lines representing the hook ends 33, so that the hold on the string is released. At this point the material web 22, along with the handle members 2, formed as loops of the string and secured by means of the strip 30, leave the surface of the cylinder 9 in a generally tangential direction in accordance with the arrow 27 at the same time that other handle members are continuously being produced in the manner described above.

In greatly enlarged scale FIGS. 6, 7 and 8 illustrate, respectively, a section of the handle member 2 and cross sections of the same taken along the lines VII—VII and VIII—VIII. In the given example the material web is shown as being two-ply but a suitable number of plies may be chosen for each given application in order to yield the desired degrees of firmness and insulation. FIGS. 7 and 8 illustrate clearly that, because of the string 28, a channel 42 is formed in the material web, i.e., between the encasing wall of the container and the strip 30, which is used as a securing strip for the string 28. Because of the great pressure applied by the pressing roller 24 to the strip 30, this channel tightly encloses the string 28 so that two layers of material, i.e., the material web 22 and the strip 30, meet and are joined together on either side of the string 28 along the lines 43 and 44. Furthermore, it is advantageous that the string 28 be lightly twined, whereby the twining may, for example, be accomplished as the string is removed from the supply roll. The string may also be of other types which display varying cross sectional form and dimension over the length of the string. The string is bent around the pins 13, which serve as supporting members, and the bent section 45 is thereby formed. The fact that the shape and dimension of the string 28 vary over the length of the string combined with the fact that the channel 42, when formed, closely follows the shape and dimension of the string and therefore also varies in regards to its shape and dimension along the length of the channel, result in a locking of the string 28 to the material webs. The string can therefore not be drawn through the channel in its longitudinal direction even if the string is severed, which is done in a later step. This is especially advantageous since one does not need to consider the ability of the string 28 to be joined using adhesive with the other parts of the container. Instead, the choice of material can be made with respect to other factors such as strength in combination with flexibility, low price, etc. The string 28 may consequently be made of material which is difficult to glue, especially onto paper. Examples of such materials are plastics such as polyethylene. The abovementioned locking is of course enhanced to a certain degree by at least the strip 30, i.e., one side of the wall of the channel 42, being provided with adhesive, which increases the friction against the string 28.

For the sake of simplicity, the device and the method have been described above with reference to the application of handle members along only one edge of the material web, but for at least some types of containers it may be more efficient to apply handle members along both edges of the material web 22.

FIG. 9 shows container material in the form of a continuous material web 22 consisting of one or several layers of paper extending over the full width of the web with paper strips 30 along both edge sections 41 of the material web and strings 28 applied in the form of loops in accordance with the invention, between the material web and the strips 30. In this arrangement the peripheral distance between each pair of pins 13 is chosen so that handle loops are formed with a desired relative separation whereby the string is allowed, in every second container, to run through the bottom of the container to which it will thereby provide a certain degree of reinforcement, just as a certain degree of reinforcement is provided by the paper strip 30 in the bottom of the containers. In a following operation, a separate device will join the material web 22 along with the handle members and strip 30 to the material web which is to form the container's opposite wall and which will have been provided with glue in accordance with some predetermined pattern so that the material webs may be glued together along the intended side edge sections 3 and 4 and the bottom edge section 6 whereupon separate containers will be obtained by means of cutting along the lines 46. At this point the strings will also be cut at their points of intersection with the lines 46. Two sections 48 of the handle member 2 are consequently affixed between the two layers of material 22 and 30. Each of these sections consists of a first portion 50 and a second portion 51, positioned at an angle to the first portion.

FIGS. 11 and 12 show clearly how the upper section of the container is constructed and how it may be closed. In the given example the container is provided with a single handle member 2 which is secured to the opening edge section 7 of one of the encasing walls. FIG. 11 shows how the container appears when it contains some object which is to be carried, whereby the flexible encasing walls are bent away from each other between the side edge sections 4 and 5 so that an opening 52 is created, through which the intended contents of the container can be inserted. The encasing wall which does not have a handle member at the top is arranged with an edge 47 folded down, which is provided with a fastening surface which consequently faces outwards from the folded down edge. When closing the container the folded down edge 47 is folded up and its fastening surface is pressed against the inside of the opposite opening edge section 7 which is provided with a surface made self-adhesive by means of a suitably chosen glue, so that the container assumes the general appearance shown in FIG. 12. In addition to closing the opening 52 the handle member 2 will hereby be anchored to both of the encasing walls opening edge sections 7 by means of the joining of the two said opening edge sections so that a uniform tension load arises in the container when it is lifted by means of the handle member 2. The fastening surface of the folded down edge 47 may also be provided with a self-adhesive material.

It is advantageous to construct the container so that it is made heat insulating by means of fashioning each of the encasing walls 53 out of at least three material layers, generally of paper, which are so embossed that they together form an encasing wall, the thickness of which is considerably greater than the sum of the thicknesses of each of the material layers (see FIGS. 13 and 14). It is also advantageous to form the one material layer 54, which comprises an outer material layer of the encasing wall, of a paper which has a thickness considerably greater than the other material layers 55 and 56. It may be pointed out that one may for example obtain a wall thickness of 2.5 mm with an outer layer 54 made of wet strong kraft paper with, for example, an area weight of 35 $g/m^2$, while the other material layers 55 and 56 may be prod from relatively thin waste paper with an area weight of, e.g., 17 $g/m^2$. All of the material layers are deformed in a similar manner, suitably by means of embossment, so that a great number of impressions 56 are obtained, extending from the original plane of each of the material layers, such a plane being designated by 58 for the outer layer 54, by 59 for the middle layer 55 and by 60 for the inner layer 56. The broken portion of the encasing wall 53, shown in FIG. 13, may be considered to be viewed from the outer layer 54, so that the impressions 57 consist of areas raised above the main plane 58. These raised areas 57, as well as the impressions in the other layers, are distributed uniformly over the entire surface of the encasing walls 53 with predetermined separation, so that spaces are created between the impressions 57, which generally correspond to or somewhat exceed the dimension of the impressions 57. These may assume a variety of different shapes and in the given example the bottom surface 61 of the impressions are shown as being square, however even polygonal or circular shapes are conceivable. As may be seen, the impressions 57 are arranged so as to form rows extending diagonally which, in the given example, implies a direction of 45° relative to the vertical or longitudinal axis of the container, so that the corners of the impressed surfaces are oriented in the direction of said axes.

Both of the other material layers, i.e., the middle layer 55 and the inner layer 56, are also provided with impressions, suitably aligned in the same direction as the impressions in the outer layer. In such case the impressions of the inner layer are located coincidentally with those of the outer layer when viewed from the side of the encasing walls, i.e., according to FIG. 13, whereas the impressions of the middle layer 55 are displaced in the direction formed by the diagonals of the squares by a distance corresponding to half the separation between the impressions so that the impressions of the middle layer fall between the impressions of the outer layer. In fig. 13 this is shown by the four impressions 62 illustrated as dotted lines. For the sake of clarity only, the remaining impressions in the middle layer have been deleted, however they are equal in number to the impressions in each of the inner and outer layers. All of the layers in each encasing wall are joined together by means of a suitably chosen glue, which is applied to the mutually facing surfaces of the material layers. It is sufficient to apply the glue, e.g., to the outer layer 54 and the inner layer 56 and for practical reasons it is suitable to do so over their entire surfaces, whereby the layers are laid together in the form of whole material webs before the container is completed in accordance with the description above. In this manner closed cells 64 are formed, which in the present example have a hexagonal cross sectional shape as is shown in FIG. 14.

The cells may for example be such as to form an angle 63° of 70° to the respective principle planes 58, 59 and 60 of the material layers. In the given example one side 57 of the impressions is approximately 1 mm in length or slightly longer. It is advantageous that the depth of the impressions be of corresponding size. The angle 63 should be as large as possible but it is limited primarily by the deformation characteristics of the material layers.

By means of the construction of the material layers described above a highly efficient heat insulating container is achieved with encasing walls which enclose closed air cells. Furthermore, a stiffness is achieved which, in relation to the thickness of the material layers, is well suited to allow the necessary flexibility in order that the container may adapt to the size and shape of the contained objects while displaying sufficient stiffness to give good protection to the contents. It is possible to displace the impressions in the middle layer 55 in a direction transverse the direction of said rows rather than diagonally, but this does not yield the same insulating ability since long, narrow surfaces thereby arise along which all three material layers are joined together. In the given example a large number of joining surfaces between the material layers is attained, which are local and where the material layers are joined with each other only in twos. In certain cases it may be desirable to choose a larger number of material layers in order to yield improved insulating ability and firmness of the container and in such cases material layers are added in the same manner, so that every other layer is displaced diagonally relative to the longitudinal direction of the impressed rows.

The invention is not limited to the example shown above but rather can be varied within the framework of the following claims. A package with two handle members can for example be produced, i.e., with a handle member affixed to the opening edge sections of each of the two walls by means of a strip along each opening edge section. Said strip 30 may also extend over the entire length of the container and, having the same width as the material web 22, thereby form one of the material layers of the container. Additionally, the support members, i.e., the pins 13, and also the traction devices 31 may be constructed and controlled in a different manner. Instead of using purely mechanical motion controlled by a cam the devices may be driven by pneumatic members with electrical position sensors. The container of the example shown is well suited for, e.g., garden products, such as flowers, plants or potted plants but it can also be given a completely different shape and be used for completely different purposes.

I claim:

1. A portable container comprising an encasing member arranged so as to form a space in which objects can be carried, and a handle member, said handle member comprising at least one handle loop of string, which over its length has a varying cross sectional dimension and is attached to the encasing member, attachment of the handle loop being accomplished in part by inserting at least one section of the string between two material layers of the encasing member, which are joined together by means of adhesive, whereby a channel is created between the layers of material through which said section of the handle member extends and in part by the varying cross sectional dimension over the length of said string when positioned in said channel upon completion of the container and by giving the channel such a form that its shape and dimensions at least to a certain extent follow said varying cross sectional in the string, whereby the handle member is secured to the encasing member even when the handle member is pulled in longitudinal direction of the channel, the encasing member consisting of two encasing walls which are joined together along at least two side edge sections and which display two opening edge sections which encircle an opening, two sections of the handle member being secured between said two material layers, said handle loop being formed by a section of the string extending freely beyond said opening edge section, said two sections of the handle member extending between said material layers each having a first section which extends essentially parallel to said opening edge section at a distance from same, and a second section which extends at an obtuse angle to said first section towards said opening edge section.

2. A portable container according to claim 1, wherein one of said material layers consists of a securing strip which is securely glued to the other material layer with string lying therebetween.

* * * * *